US008005397B2

(12) United States Patent
Sato

(10) Patent No.: US 8,005,397 B2
(45) Date of Patent: Aug. 23, 2011

(54) IMAGE FORMING APPARATUS

(75) Inventor: Shougo Sato, Seto (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 635 days.

(21) Appl. No.: 12/130,156

(22) Filed: May 30, 2008

(65) Prior Publication Data

US 2009/0169245 A1 Jul. 2, 2009

(30) Foreign Application Priority Data

May 31, 2007 (JP) ..... 2007-144765

(51) Int. Cl.
*G03G 21/16* (2006.01)

(52) U.S. Cl. ..... 399/111; 399/110; 399/119

(58) Field of Classification Search ..... 399/107, 399/110, 119, 124
See application file for complete search history.

(56) References Cited

U.S. PATENT DOCUMENTS

| | | | | |
|---|---|---|---|---|
| 5,477,306 | A * | 12/1995 | Iguchi et al. | 399/46 |
| 6,377,765 | B1 | 4/2002 | Shishido et al. | |
| 7,649,543 | B2 * | 1/2010 | Tanabe | 347/242 |
| 2008/0247793 | A1 | 10/2008 | Sato et al. | |
| 2009/0052938 | A1 | 2/2009 | Samejima et al. | |
| 2009/0180802 | A1 | 7/2009 | Sato et al. | |

FOREIGN PATENT DOCUMENTS

| | | | |
|---|---|---|---|
| JP | 02-140762 | | 5/1990 |
| JP | 05-249767 | | 9/1993 |
| JP | 6-166209 | A | 6/1994 |
| JP | 2001-117306 | A | 4/2001 |
| JP | 2003-112446 | | 4/2003 |
| JP | 2003-255805 | A | 9/2003 |
| JP | 2006-018126 | A | 1/2006 |
| JP | 2006-058454 | A | 3/2006 |
| JP | 2007-199733 | A | 8/2007 |
| JP | 2008-032755 | A | 2/2008 |
| JP | 2008-250028 | A | 10/2008 |
| JP | 2009-047992 | A | 3/2009 |

OTHER PUBLICATIONS

Notification of Reasons for Refusal mailed Jan. 18, 2011 in Japanese Application No. 2008-142157 and English translation thereof.

* cited by examiner

*Primary Examiner* — Hoang Ngo
(74) *Attorney, Agent, or Firm* — Banner & Witcoff, Ltd.

(57) ABSTRACT

An image forming apparatus includes: a process unit including a photosensitive element; an exposure member exposing the photosensitive element to light to form an electrostatic latent image on the photosensitive element; a main body casing accommodating the process unit and the exposure member; and a developer cartridge supplying developer to the process unit. The developer cartridge is attachable to and removable from the process unit. In this image forming apparatus, the exposure member is positioned between the photosensitive element and the developer cartridge so as to be attached and movable between a first position in which the photosensitive element is exposed to light by the exposure member and a second position in which the exposure member is away from the photosensitive element. Further, the developer cartridge has a pressing portion for pressing the exposure member toward the first position with the developer cartridge being attached to the main body casing.

14 Claims, 11 Drawing Sheets

REAR
FRONT
A
1
2
3
4
6
6A
7
8
9
10
11
11A
12
12A
13
13A
14
14A
15
16
17
18
19
20
23
24
24A
26
29
29d
30
31
32
40
42
42A
192a
206
206a
206b
302

IMAGE FORMING APPARATUS

CROSS REFERENCE TO RELATED APPLICATIONS

This application claims the foreign priority benefit under Title 35, United States Code, §119(a)-(d) of Japanese Patent Application No. 2007-144765 filed on May 31, 2007 in the Japan Patent Office, the disclosure of which is herein incorporated by reference in its entirety.

BACKGROUND OF THE INVENTION

The present invention relates to an image forming apparatus equipped with an exposure member, which is movable toward and away from a photosensitive element.

Generally, in a known image forming apparatus, a photosensitive drum (photosensitive element) is electrically charged and this electrically charged photosensitive drum is then irradiated with light so that the electric potential of the irradiated area lowers to form an electrostatic latent image on the photosensitive drum. Thereafter, developer is supplied onto this latent image to form a developer image, which is then transferred onto a paper so that a predetermined image is formed on the paper.

As one example of such an image forming apparatus, Japanese Laid-open Patent Publication No. 2003-112446 discloses an image forming apparatus, which is equipped with an LED head for emitting light and irradiating a photosensitive drum with the light, and a top cover supporting the LED head and pivotally connected to the main body of the apparatus. In this image forming apparatus, opening the top cover causes the LED head to be retracted from the photosensitive drum, whereas closing the top cover causes the LED head to be positioned in a predetermined position with respect to the photosensitive drum.

Typically, the top cover is not required for positioning the LED head with respect to the photosensitive element. However, in this image forming apparatus disclosed in JP 2003-112446, the LED head is pressed and urged by the top cover toward the photosensitive element to carry out the positioning of the LED head. Therefore, the top cover does not provide a stable and accurate pressing force, which may result in a difficulty in accurate positioning between the LED head and the photosensitive element.

Further, it is difficult to effectively use the internal space of the image forming apparatus in which the LED head is supported by the pivotable top cover. This is because the moving passage (trajectory) of the LED head becomes longer and hence it is necessary to arrange the process unit, etc. so as not to cause interference with the LED head.

In view of the foregoing drawbacks of the prior art, the present invention seeks to provide an image forming apparatus in which accurate positioning of the exposure member to the photosensitive element is readily performed while the internal space of the apparatus can be used effectively.

SUMMARY OF THE INVENTION

According to the present invention, an image forming apparatus comprises: a process unit including a photosensitive element; an exposure member configured to expose the photosensitive element to light to form an electrostatic latent image on the photosensitive element; a main body casing configured to accommodate the process unit and the exposure member; and a developer cartridge configured to supply developer to the process unit. The developer cartridge is configured to be attached to and removed from the process unit. In this image forming apparatus, the exposure member is positioned between the photosensitive element and the developer cartridge so as to be attached and movable between a first position in which the photosensitive element is exposed to light by the exposure member and a second position in which the exposure member is away from the photosensitive element. Further, the developer cartridge has a pressing portion, and the pressing portion is configured to press the exposure member toward the first position with the developer cartridge being attached to the main body casing.

In order to stably and reliably supply developer to the process cartridge, the developer cartridge is attached to the process cartridge with a relatively high positioning accuracy. Therefore, the exposure member is accurately pressed by the pressing portion of the developer cartridge toward the photosensitive element. As a result, it is possible to readily perform an accurate positioning of the exposure member relative to the photosensitive element.

Further, the moving passage (trajectory) of the exposure member can be shortened to such an extent that the pressing portion of the developer cartridge causes the exposure member to move to the photosensitive element. This makes it possible to effectively use the internal space of the image forming apparatus.

According to the present invention, since the pressing portion of the developer cartridge presses the exposure member and causes the exposure member to move from the second position to the first position, an accurate positioning of the exposure member relative to the photosensitive element is readily performed while the internal space of the image forming apparatus can be used effectively.

Other features and advantages of the present invention will be apparent from the following description taken in conjunction with the accompanying drawings.

BRIEF DESCRIPTION OF THE DRAWINGS

Other objects and aspects of the present invention will become more apparent by describing in detail illustrative, non-limiting embodiments thereof with reference to the accompanying drawings, in which:

FIGS. 3A and 3B are vertical sections of the printer, in which FIG. 3A illustrates a state where the toner cartridge is attached to the printer, and FIG. 3B illustrates a state where the toner cartridge is ready for removal from the printer;

FIGS. 4A and 4B are views showing a process cartridge of FIGS. 3A and 3B, in which FIG. 4A is a sectional view of the process cartridge, and FIG. 4B is a sectional view taken along the line X-X of FIG. 4A;

FIGS. 5A and 5B are side views showing the toner cartridge and its operating portion, in which FIG. 5A illustrates a state where the operating portion is in an open position, and FIG. 5B illustrates a state where the operating portion is in a closed position;

FIGS. 6A to 6D are views showing the toner cartridge, in which FIG. 6A is a rear view illustrating a state where the operating portion is in the open position, FIG. 6B is a sectional view of FIG. 6A, FIG. 6C is a rear view illustrating a state where the operating portion is in the closed position, and FIG. 6D is a sectional view of FIG. 6C;

FIGS. 7A and 7B are perspective views of the cartridge body, in which FIG. 7A shows the cartridge body in the open position, and FIG. 7B shows the cartridge body in the closed position;

FIGS. 8A to 8C are views showing details of an LED head, in which FIG. 8A is a view as seen from a direction of arrow Y of FIG. 4A, FIG. 8B is a sectional view taken along the line Z-Z of FIG. 8A and illustrating a state where the LED head is in a retracted position, and FIG. 8C is a sectional view taken along the line Z-Z of FIG. 8A and illustrating a state where the LED head is in a light-exposure position;

FIGS. 10A and 10B are vertical sections of the printer illustrating a detachment passage for the cartridge body, in which FIG. 10A shows a starting position for attachment of the cartridge body, and FIG. 10B shows an intermediate position at which the cartridge body is halfway through the attachment; and FIGS. 11A and 11B are vertical sections of the printer illustrating the detachment passage for the cartridge body, in which FIG. 11A illustrates a state where the cartridge body is inserted farther from the position of FIG. 10B, and FIG. 11B shows the cartridge body in an attached position.

DETAILED DESCRIPTION OF THE INVENTION

One preferred embodiment of the present invention will be described in detail with reference to the attached drawings.

Exterior of Printer

Figure 1:
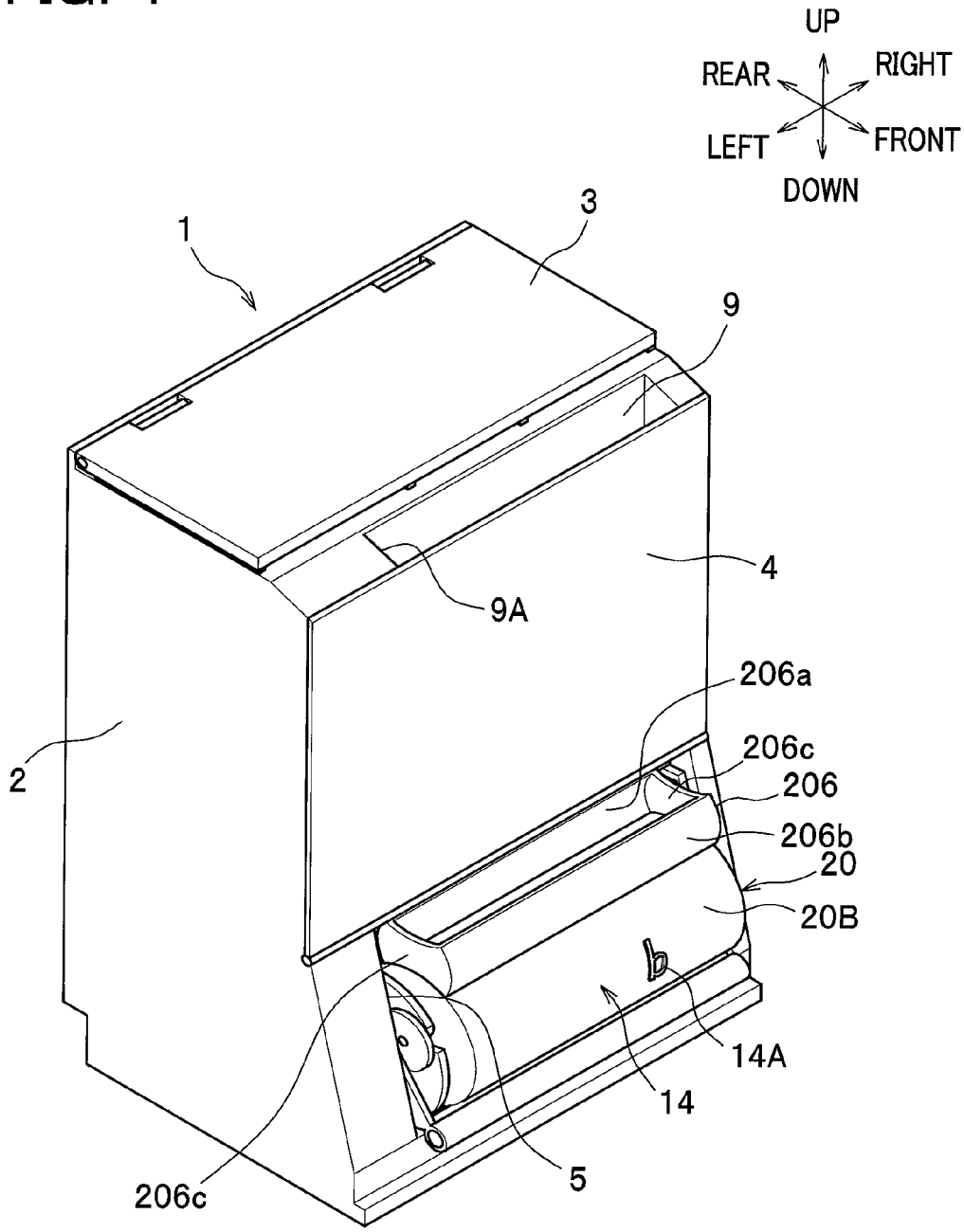
FIG. 1 is a perspective view of a printer as an image forming apparatus according to one preferred embodiment of the present invention.
Figure 2:
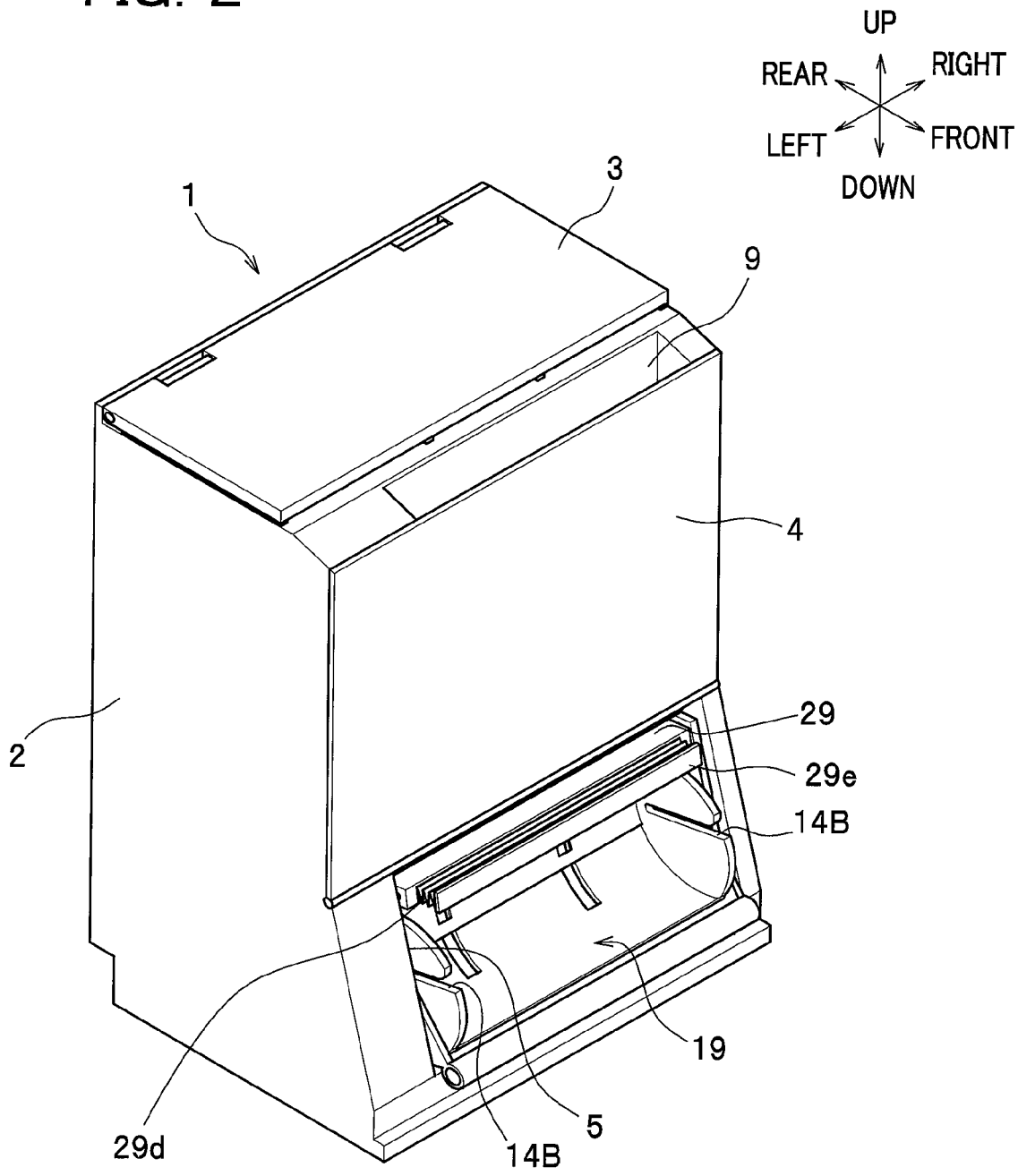
FIG. 2 is a perspective view of the printer illustrating a state where a toner cartridge is removed from the printer.

As seen in FIGS. 1 and 2, an image forming apparatus according to one embodiment of the present invention is provided as an upright-type printer 1, which has a relatively short length in the front-rear direction compared to the right-and-left direction and the height of which is tall.

The printer 1 has a main body casing 2. A top cover 3 is provided at an upper part of the main body casing 2, and a front cover 4 is provided at a front upper part of the main body casing 2. Provided at a front lower part of the main body casing 2 is an attachment opening 5, through which the attachment and detachment of a process cartridge 14 and a toner cartridge 20 are performed. The process cartridge 14 constitutes an image forming unit 8 to be described later, and the toner cartridge 20 is an example of a developer cartridge. In this preferred embodiment, the front cover 4 constitutes a part of the main body casing 2.

Internal Structure of Printer

Figures 3A, 3B:
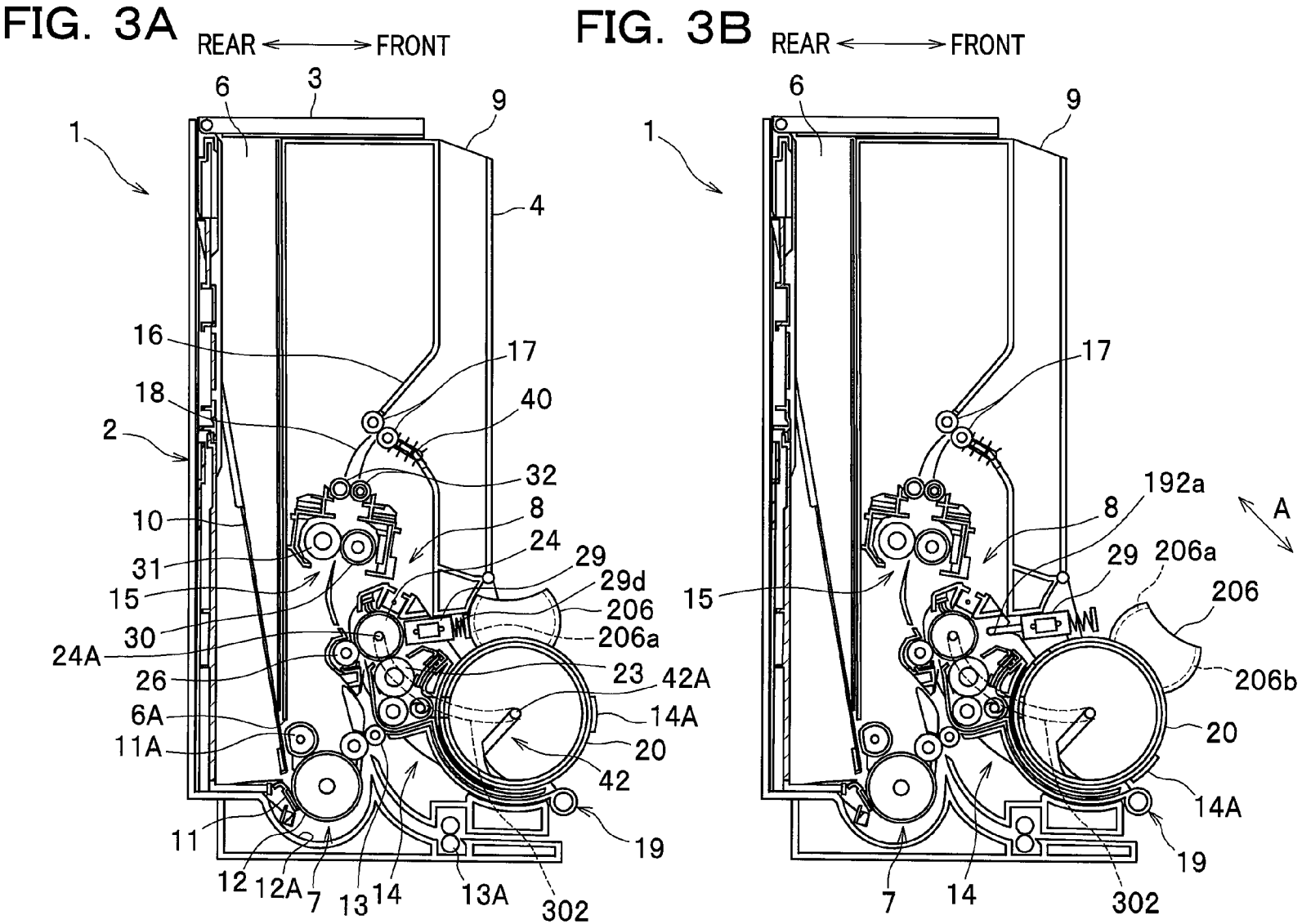

As seen in FIG. 3A, a sheet feed tray 6, a feeder unit 7, an image forming unit 8, and a sheet output tray 9 are arranged in the main body casing 2. The sheet feed tray 6 stores a stack of papers (or sheets) (not shown) as recording sheets in a state where the papers are placed substantially in an upright position, and the feeder unit 7 pulls a paper (not shown) downward from the sheet feed tray 6 and feeds out the paper to the image forming unit 8. The image forming unit 8 forms an image on the paper that is carried from the feeder unit 7. The sheet output tray 9 receives the paper on which the image is formed by the image forming unit 8, and stacks and stores sheets of paper substantially in an upright position.

Structure of Sheet Feed Tray

The sheet feed tray 6 is attached to and detachable from the rear side of the main body casing 2. The sheet feed tray 6 can be pulled out upward from the main body casing 2. The rear end portion of the top cover 3 is pivotally connected to the upper end portion of the sheet feed tray 6 so that when the front end portion of the top cover 3 is lifted in the upward direction, a sheet loading opening opens at the upper part of the sheet feed tray 6. Further, a sheet pressure plate 10 is pivotally supported in the sheet feed tray 6 so as to press the lower end of the stack of papers toward a sheet feed opening 6A provided at the front lower part of the sheet feed tray 6.

Structure of Feeder Unit

The feeder unit 7 is positioned adjacent to the sheet feed opening 6A at the front lower part of the sheet feed tray 6. As best seen in FIG. 3A, the feeder unit 7 includes a separation roller 12 and a separation pad 11 between which the lower end of the paper (i.e., leading edge of the paper along the conveyance direction) is fed so that the paper is separated and fed on one-by-one basis, and a registration roller 13 with which the leading edge of the paper that is conveyed from the separation roller 12 is brought into contact so that the paper is temporarily constrained and thereafter conveyed upward to the image forming unit 8. The registration roller 13 is positioned just above the separation roller 12, and conveys the paper upward to the image forming unit 8.

Structure of Image Forming Unit

The image forming unit 8 at least includes a process cartridge 14 and a fixing device 15. The process cartridge 14 is attachable to the main body casing 2 through the attachment opening 5 of the main body casing 2 as shown in FIGS. 1 and 2, and positioned below the sheet output tray 9. See FIG. 3A. The fixing device 15 is installed in advance in an installation space between the sheet output tray 9 and the sheet feed tray 6. The fixing device 15 is positioned above the process cartridge 14.

Structure of Sheet Output Tray

The sheet output tray 9 is positioned in the main body casing 2 at the front side of the main body casing 2 with an installation space for the fixing device 15, etc. being left between the sheet output tray 9 and the sheet feed tray 6. The bottom of the sheet output tray 9 is positioned higher than the bottom portion of the sheet feed tray 6. Provided below the sheet output tray 9 is an installation space for the process cartridge 14, which constitutes the image forming unit 8.

The lower end portion of the front cover 4 is pivotally connected to the lower end portion of the sheet output tray 9. When the upper end of the front cover 4 is lifted down in the forward direction, the front side of the sheet output tray 9 opens so that the papers stored in the sheet output tray 9 can be readily removed.

Further, as seen in FIG. 1, the upper end of the sheet output tray 9 contains a sheet output opening 9A whose lateral width is greater than that of the paper (i.e., width of the paper in the direction orthogonal to the sheet conveyance direction), so that sheets of paper can be removed also through this opening 9A.

A recess 16 is formed in the rear wall of the sheet output tray 9 at a vertically intermediate portion thereof. The recess 16 dents toward a space above the fixing device 15. Provided at the bottom portion of the recess 16 are a pair of sheet ejection rollers 17, 17 for drawing a paper into the sheet output tray 9. For the purpose of guiding the paper from the fixing device 15 to the pair of sheet ejection rollers 17, 17, a sheet guide 18 is formed in the main body casing 2. Further, a conveyor belt 40 is provided in the recess 16 so as to hold the leading edge of the paper and convey the same in the forward direction. The conveyor belt 40 is provided at a front side of and adjacent to the sheet ejection rollers 17, 17. A plurality of projections are formed on the surface of the conveyor belt 40 such that the leading edge of the paper is properly held and conveyed to the lower portion of the sheet output tray 9.

Structure of Process Cartridge

Figure 4A:
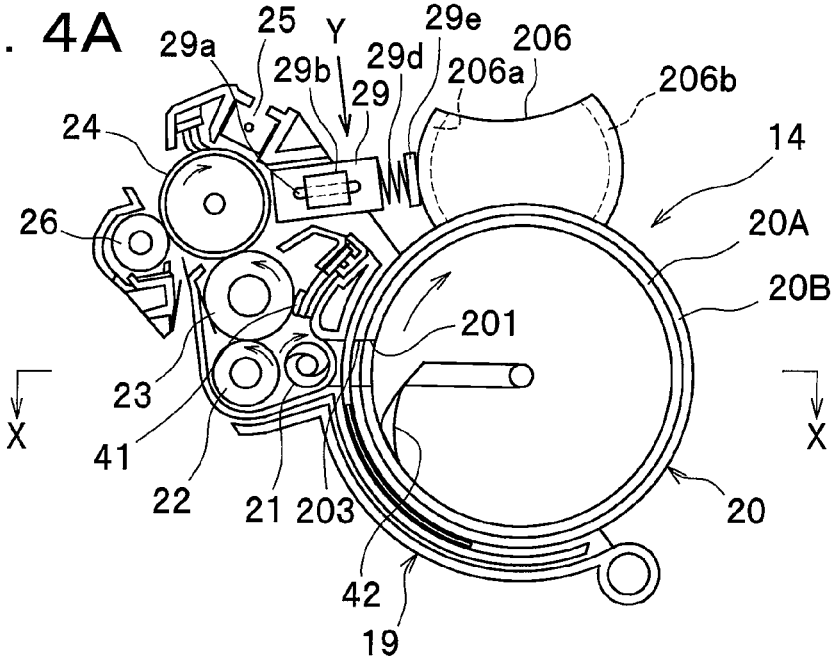

As seen in FIG. 4A, the process cartridge 14 includes the toner cartridge 20 which is detachably mounted to the cartridge body 19. The process cartridge 14 also includes a toner feed auger 21, a supply roller 22, a developing roller 23, a photosensitive drum 24, a charger 25, and a transfer roller 26, which are installed in advance in the cartridge body 19.

The cartridge body 19 including the photosensitive drum 24 corresponds to an example of the process unit.

Structure of Toner Cartridge

The toner cartridge 20 includes an inner cylinder 20A in the form of a hollow cylinder, and an outer cylinder 20B which is rotatable relative to the inner cylinder 20A and functions as a first shutter.

Figure 4B:
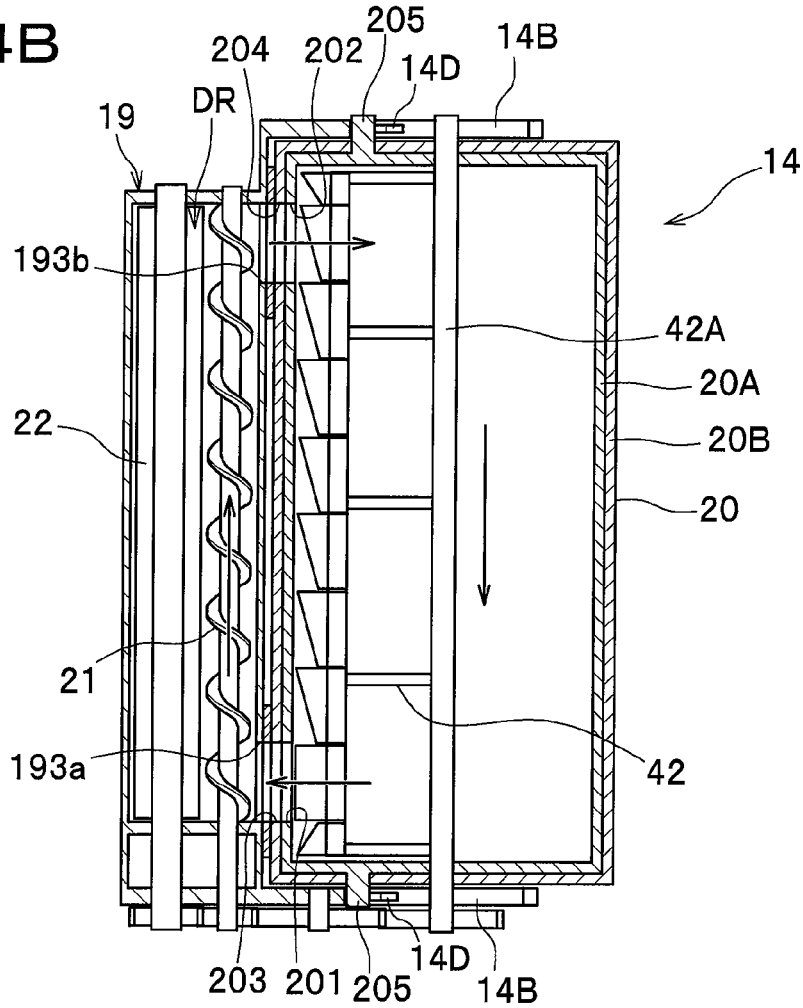

As seen in FIG. 4B, a toner supply opening 201 is formed at one end of the inner cylinder 20A. The toner supply opening 201 is an example of an opening through which toner is supplied from the toner cartridge 20 into a development chamber DR that is defined in the cartridge body 19. Formed at the other end of the inner cylinder 20A is a toner return opening 202 through which toner is returned from the development chamber DR to the inner cylinder 20A. An agitator 42 is rotatably supported in the inner cylinder 20A. The agitator 42 has a plurality of blades whose shapes are designed to agitate toner and feed the toner in one direction of the inner cylinder 20A.

The agitator 42 is driven to rotate when a drive source (not shown) supplies a driving force to the agitator 42. A rotation shaft 42A of the agitator 42 penetrates through and protrudes outward from both ends (right and left ends) of the inner cylinder 20A and the outer cylinder 20B. Protrusions 205, 205 are formed offset from the center of both ends of the inner cylinder 20A. The protrusions 205, 205 protrude outward along an axial direction of the rotation shaft 42A of the agitator 42. As will be described later, when the protrusions 205, 205 and the rotation shaft 42A of the agitator 42 are brought into engagement with guide grooves 14B, 14B formed in the cartridge body 19, the inner cylinder 20A becomes non-rotatable relative to the cartridge body 19.

The outer cylinder 20B includes a tonner supply opening 203 and a toner return opening 204 each corresponding to the toner supply opening 201 and the toner return opening 202 of the inner cylinder 20A. Further, as shown in FIGS. 5A and 5B, an operating portion 206 and engagement protrusions 207, 207 (only one is shown in the figures) are provided on the outer periphery of the outer cylinder 20B.

The operating portion 206 includes a pressing wall 206*a* as an example of a pressing portion in the form of a semi-cylindrical surface, a holding wall 206*b* in the form of a semi-cylindrical surface and positioned ahead and opposite of the pressing wall 206*a*, and a pair of side walls 206*c* (see FIG. 1) connecting the right and left ends of the pressing wall 206*a* with the right and left ends of the holding wall 206*b*. The holding wall 206*b* is held by a user. When the user holds and operates the holding wall 206*b*, as seen in FIGS. 6B and 6D, the toner supply opening 201 and the toner return opening 202 of the inner cylinder 20A are opened or closed by the outer cylinder 20B which functions as the first shutter. To be more specific, when the operating portion 206 is rotated to the upward position of the outer cylinder 20B (hereinafter referred to as an "open position") as shown in FIG. 5A, the tonner supply opening 201 and the toner return opening 202 of the inner cylinder 20A are opened to the outside via the toner supply opening 203 and the toner return opening 204 of the outer cylinder 20B as shown in FIG. 6B. Meanwhile, when the operating portion 206 is rotated to a position that is slightly forward from the open position (hereinafter referred to as a "closed position") as shown in FIG. 5B, the tonner supply opening 201 and the toner return opening 202 of the inner cylinder 20A are closed by the outer peripheral wall of the outer cylinder 20B as shown in FIG. 6D. As seen in FIG. 1, when the operating portion 206 is positioned in the open position, a logo 14A formed on the outer peripheral surface of the outer cylinder 20B can be seen from the front side of the printer 1.

Operating the holding wall 206*b* causes the pressing wall 206*a* to move substantially in the front-rear direction. When the pressing wall 206*a* moves from the position shown in FIG. 3B to the position shown in FIG. 3A, an LED head 29 that is slidably supported in the main body casing 2 is pressed substantially in the rearward direction by the pressing wall 206*a*. To be more specific, as best seen in FIG. 3A, when the operating portion 206 is rotated to the open position with the toner cartridge 20 being attached to the cartridge body 19, the pressing wall 206*a* is positioned in a pressing position where the pressing wall 206*a* presses the LED head 29 to position the LED head 29 in a light-exposure position (first position) to be described later. On the contrary, as best seen in FIG. 3B, when the operating portion 206 is rotated to the closed position, the pressing wall 206*a* is positioned in a disengaged position where the pressing wall 206*a* is disengaged from LED head 29. The term "with the toner cartridge 20 being attached to the cartridge body 19" indicates that both the cartridge body 19 and the toner cartridge 20 are attached to the main body casing 2. More specifically, when the outer cylinder 20B closes the toner supply opening 201 and the toner return opening 202 of the inner cylinder 20A, the pressing wall 206*a* is positioned away from the LED head 29. The sliding structure of the LED head 29 will be described later.

Figure 5A:
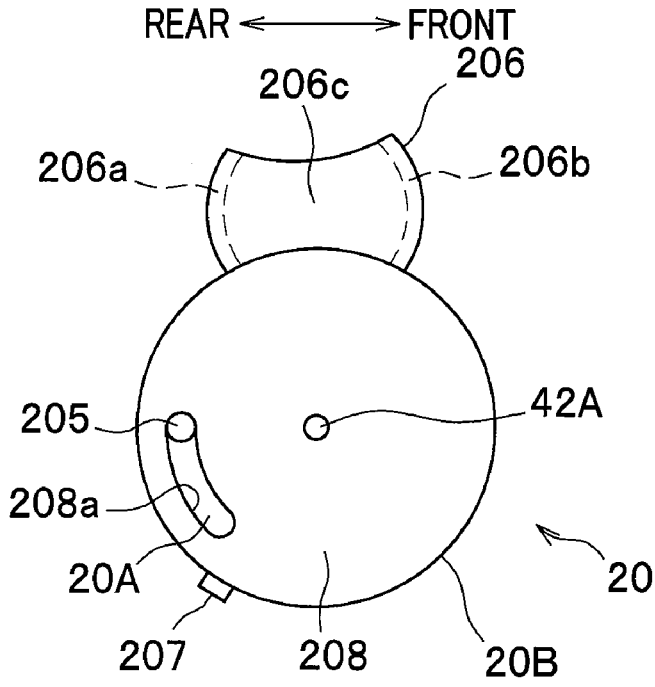
Figure 5B:
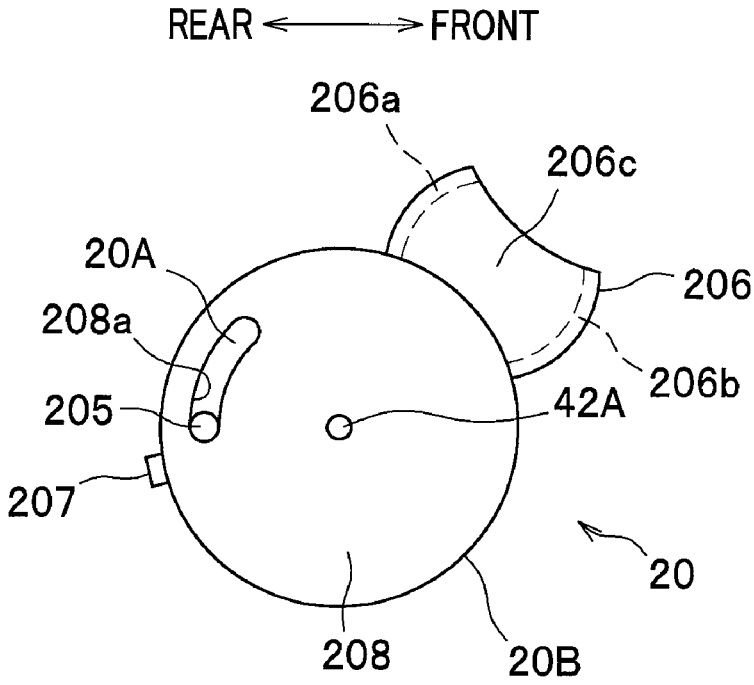
Figure 6A:
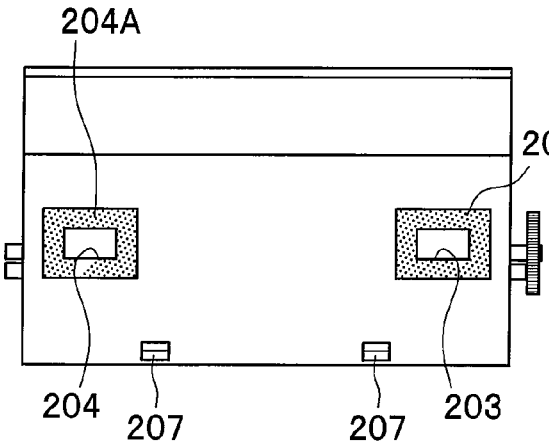
Figure 6B:
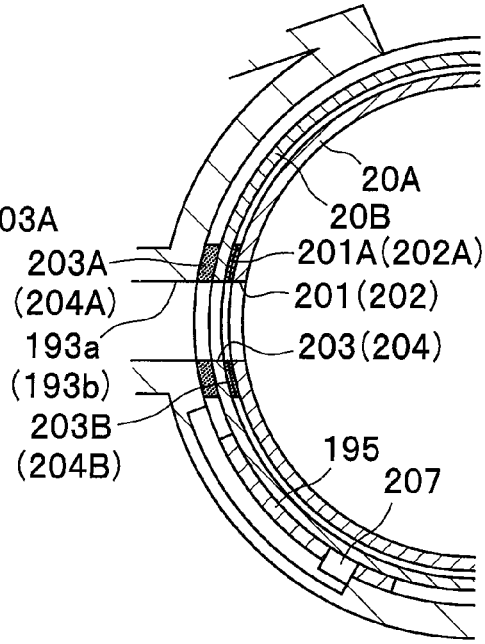
Figure 6C:
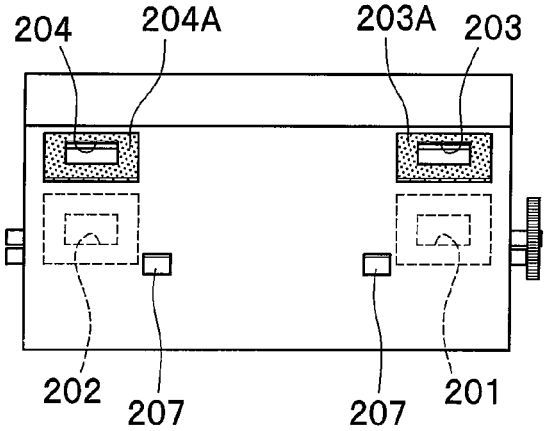
Figure 6D:
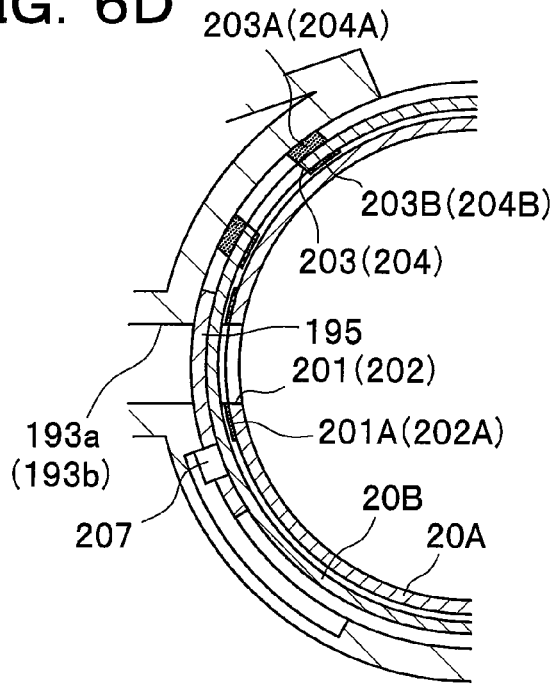

As seen in FIGS. 5A and 5B, the engagement protrusions 207, 207 are integrally formed on the outer periphery of the outer cylinder 20B. Each engagement protrusion 207 protrudes radially outward from the outer peripheral surface of the outer cylinder 20B, and is engageable with a corresponding engagement opening 195*a* (see FIGS. 7A and 7B) formed in a rotary wall 195 of the cartridge body 19 to be described later. As best seen in FIG. 6A, the engagement protrusions 207, 207 are provided in pair in the right-and-left direction slightly below the toner supply opening 203 and the toner return opening 204.

Further, as seen in FIG. 5A, an arcuate elongate hole 208*a* is formed in each end wall 208 of the outer cylinder 20B so that the protrusion 205 of the inner cylinder 20A engages therein. This allows a relative rotation of the outer cylinder 20B with respect to the inner cylinder 20A as well as restricts the rotation range of the outer cylinder 20B.

As best seen in FIG. 6A, sponge members 203A, 204A are provided on the outer peripheral surface of the outer cylinder 20B around the toner supply opening 203 and the toner return opening 204. As best seen in FIG. 6D, sponge members 203B, 204B as an example of a restriction member are also provided on the inner peripheral surface of the outer cylinder 20B around the toner supply opening 203 and the toner return opening 204. In accordance with the positions of the sponge members 203B, 204B, sponge members 201A, 202A are provided on the outer peripheral surface of the inner cylinder 20A around the toner supply opening 201 and the toner return opening 202. Therefore, as seen in FIG. 6B, these sponge members provide seals to prevent leakage of toner upon supplying the toner from the inner cylinder 20A to the development chamber DR. Because of the frictional force generated by the contact between the sponge members 201A, 202A of the inner cylinder 20A and the sponge members 203B, 204B of the outer cylinder 20B, the outer cylinder 20B is positioned with respect to the main body casing 2 through the inner cylinder 20A and the cartridge body 19. Accordingly, the outer cylinder 20B is positioned in the open position. As described later, urging force of a retracting spring 400 also prevents the outer cylinder 20B from being displaced from the open position.

For the purpose of explanation, in FIG. 6D, the sponge members 203B, 204B provided on the inner peripheral surface of the outer cylinder 20B are shown as if they are at a distance from the inner cylinder 20A; however, the sponge members 203B, 204B are actually in contact with the inner cylinder 20A. Accordingly, the outer cylinder 20B is positioned in the closed position. The mechanism for positioning the outer cylinder 20B with respect to the inner cylinder 20A (main body casing 2) in the open position or the closed position is not limited to the above mechanism using the sponge members. For example, a locking block urged by a spring may be inserted into a recess formed in the inner cylinder 20A.

As best seen in FIG. 3A, the toner cartridge 20 as described above is arranged closer to the sheet output tray 9 than the developing roller 23. The toner cartridge 20 is attached to the cartridge body 19 such that the rotation shaft 42A of the agitator 42 is positioned ahead of the front surface of the front cover 4. In other words, the sheet output tray 9 is arranged more inward than the toner cartridge 20 (i.e., on the light-exposure position side of the LED head 29 in a direction in which the LED head 29 is movable, e.g., slidable).

According to the configuration of the toner cartridge 20 as described above, most of the toner cartridge 20 protrudes forward from the attachment opening 5 (FIG. 1) to the outside of the main body casing 2. This makes it possible to save the installation space for the toner cartridge 20 within the main body casing 2 as well as to reduce the vertical size of the printer 1 while enlarging the capacity of the toner cartridge 20. According to the present invention, the arrangement of the LED head 29 between the photosensitive drum 24 and the toner cartridge 20 allows the toner cartridge 20 to protrude outward from the main body casing 2.

Further, the toner cartridge 20 is positioned on the light-exposure position side of the LED head 29 in the direction in which the LED head 29 is slidable such that the pressing wall 206*a* is in the disengaged position. Therefore, the pressing wall 206*a* is brought into contact with the LED head 29 by using a simple mechanism, which leads to effective use of the internal space of the printer 1.

Structure of Cartridge Body

Figure 7A:
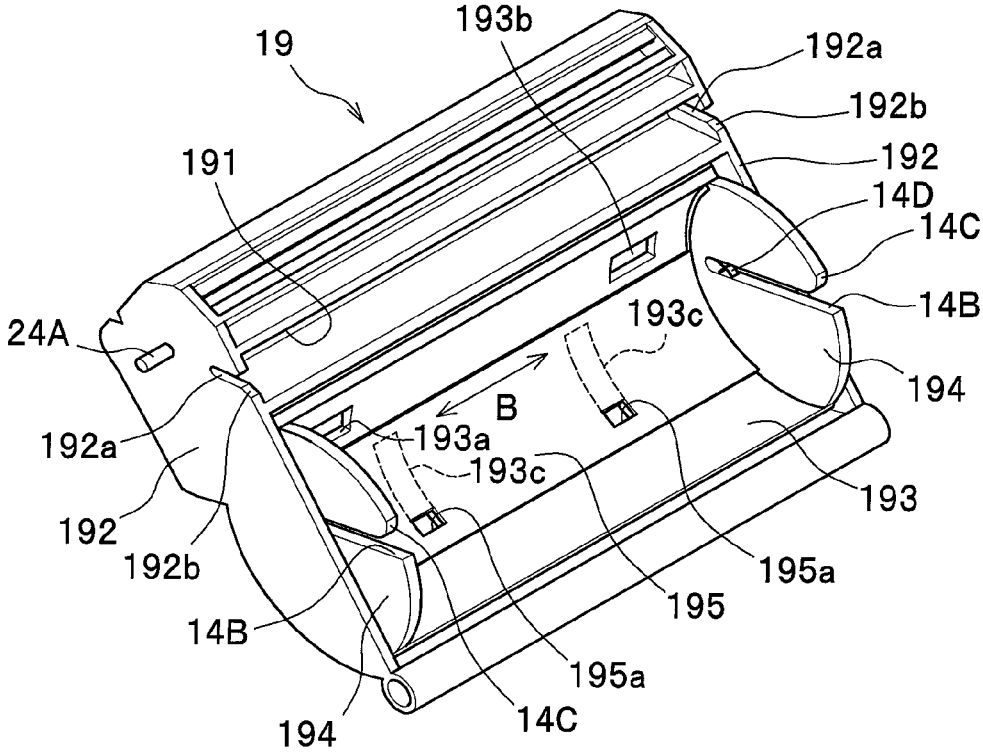
Figure 7B:
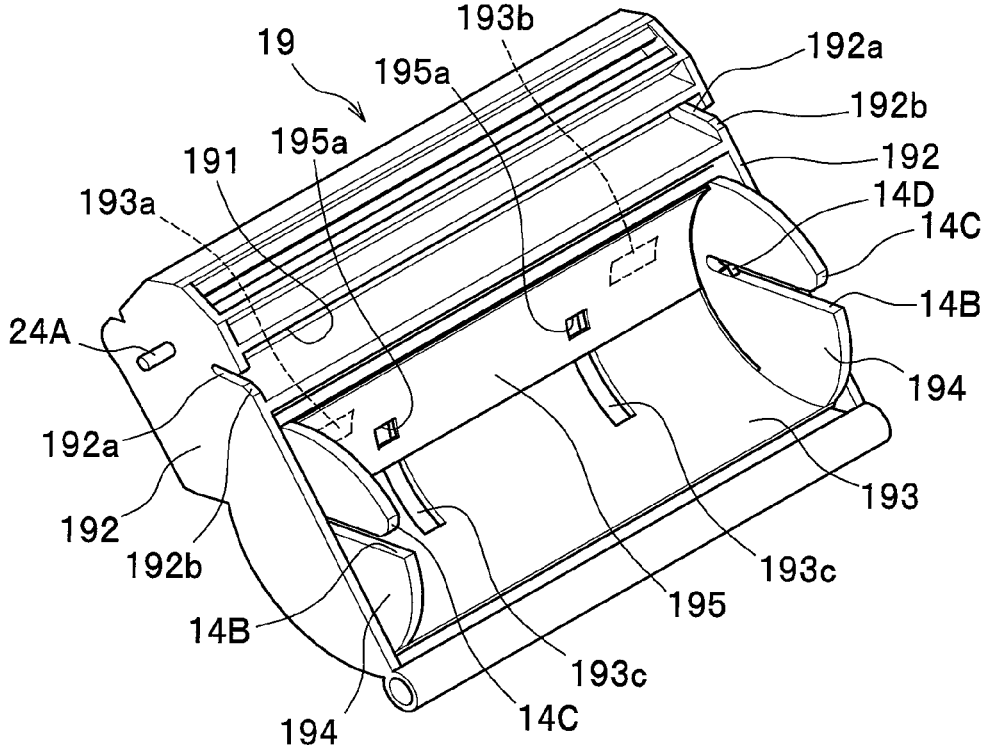

As seen in FIGS. 7A and 7B, the cartridge body 19 includes therein an undercut 191 along which the LED head 29 is movable in the right-and-left directions. The undercut 191 is defined between right and left side walls 192, 192 formed with engagement grooves 192*a*, 192*a* as an example of an engagement portion along which the LED head 29 is slidable to and positioned in the light-exposure position (where the photosensitive drum 24 is exposed to light by the LED head 29). To be more specific, each of the engagement grooves 192*a*, 192*a* is shaped linearly and permits a sliding engagement with a slide protrusion 29*a* that is formed on the side surface of the LED head 29 as shown in FIG. 4A. A taper-shaped guide surface 192*b* is formed at the front end of the engagement groove 192*a* to facilitate inserting the slide protrusion 29*a* of the LED head 29 into the corresponding engagement groove 192*a*.

As best seen in FIGS. 7A and 7B, a semi-cylindrical recess 193 is formed in the cartridge body 19, to which the toner cartridge 20 is attached. The recess 193 is defined between right and left side walls 194, 194 formed with guide grooves 14B, 14B. The guide grooves 14B, 14B slidably support the protrusions 205, 205 and the rotation shaft 42A of the agitator 42 (FIG. 4B) which protrude from both ends of the toner cartridge 20. The guide grooves 14B, 14B are substantially parallel to the engagement grooves 192*a*, 192*a*, so that the attachment and detachment directions of the toner cartridge 20 to and from the cartridge body 19 are substantially equal to the sliding directions of the LED head 29.

A taper-shaped guide surface 14C is formed at the front end of each guide groove 14B to facilitate inserting the protrusion 205 and the rotation shaft 42A into the corresponding guide groove 14B. An elastically deformable retaining spring 14D is provided at the rear side of each guide groove 14B. When the user fits the toner cartridge 20 into the recess 193 such that the protrusions 205, 205 slide along the guide grooves 14B, 14B to the rear end of the guide grooves 14B, 14B against the urging force of the retaining springs 14D, 14D, the retaining springs 14D, 14D are deformed and then returned to their original position to retain the protrusions 205, 205. Therefore, the toner cartridge 20 (specifically the inner cylinder 20A) is mounted to the cartridge body 19.

A toner supply opening 193*a* as an example of a supply opening and a toner return opening 193*b* as an example of a return opening are formed in the recess 193 of the cartridge body 19. The toner supply opening 193*a* and the toner return opening 193*b* are in communication with the development chamber DR (FIG. 4B) and correspond to the toner supply opening 203 and the toner return opening 204 of the outer cylinder 20B. The recess 193 is provided with a rotary wall 195 as an example of a second shutter, which is slidable (rotatable) to open and close the toner supply opening 193*a* and the toner return opening 193*b*. Further, a pair of engagement holes 195*a*, 195*a* are formed in the rotary wall 195 at predetermined positions, and arcuate grooves 193*c*, 193*c* as an example of a groove are formed in the sliding surface of the recess 193 on which the rotary wall 195 slides. When the pair of engagement protrusions 207, 207 of the outer cylinder 20B (FIGS. 5A and 5B) are fitted into and penetrate through the engagement holes 195*a*, 195*a*, the arcuate grooves 193*c*, 193*c* allow the sliding movement of the engagement protrusions 207, 207 protruding from the engagement holes 195*a*, 195*a*.

Operation of Process Cartridge

As seen in FIG. 4B, toner stored in the toner cartridge 20 is carried to one end of the toner cartridge 20 by the agitator 42. Also, the agitator 42 supplies the toner that has been carried to the one end of the toner cartridge 20, through the toner supply opening 201 formed at the one end of the toner cartridge 20 to the development chamber DR defined in the cartridge body 19.

Further, the toner introduced into the development chamber DR is carried to the other end of the toner cartridge 20 by the toner feed auger 21. Therefore, toner is uniformly supplied on the surface of the supply roller 22 along the axial direction of the supply roller 22. The toner carried to the other end of the toner cartridge 20 within the development chamber DR is returned to the toner cartridge 20 through the toner return opening 202 formed in the other end of the toner cartridge 20.

The toner that is supplied to the surface of the supply roller 22 makes a frictional contact with the developing roller 23 and is charged positively. Therefore, the toner adheres and is deposited on the surface of the developing roller 23. A doctor blade 41 regulates the deposited toner on the developing roller 23 to a thin layer having a constant thickness.

The photosensitive drum 24 includes a photosensitive layer having positive charge characteristics. When a charger 25 generates and applies a corona discharge from a charge wire made of, e.g., tungsten, the photosensitive layer formed on the surface of the photosensitive drum 24 is uniformly charged to the positive polarity. The LED head 29 supported in the main body casing 2 then exposes the positively charged photosensitive layer on the photosensitive drum 24 to light based on image data. This exposure process lowers the potential of a light-exposed area on the photosensitive layer, so that an electrostatic latent image associated with the image data is formed on the photosensitive drum 24.

Toner positively charged and carried on the developing roller 23 is attracted to the latent image that is formed on the photosensitive layer of the photosensitive drum 24. By this reversal process, a toner image is formed on the photosensitive layer of the photosensitive drum 24. A paper is conveyed along a sheet conveyance passage and passes between the photosensitive drum 24 which carries the toner image on the photosensitive layer and a transfer roller 26, during which the toner image is transferred on the paper. The transfer roller 26 includes a roller shaft, which is made of metal and covered with a conductive rubber material. When a transfer bias is applied to the transfer roller 26, the toner image formed on the photosensitive drum 24 is transferred to the paper.

Structure of LED Head

Figure 8A:
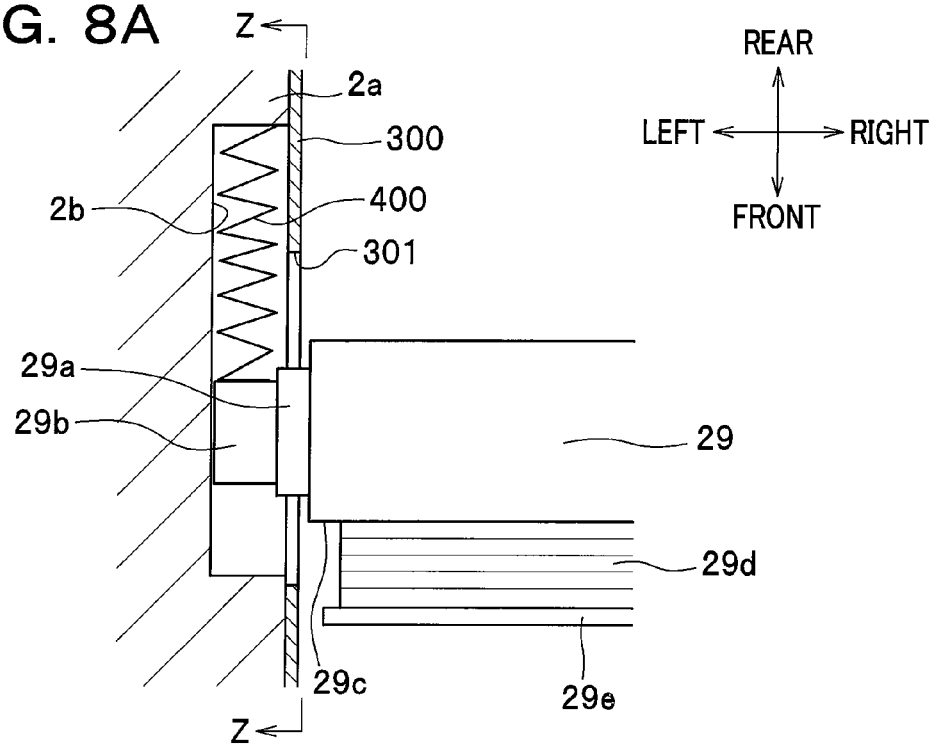

As seen in FIG. 4A, the LED head 29 as an example of an exposure member has a plurality of light-emitting diodes (LEDs) (not shown) arranged in a row along the axial direction of the photosensitive drum 24 so that turning on/off each LED based on predetermined data performs exposure of the photosensitive drum 24 to form an electrostatic latent image on the photosensitive drum 24. As seen in FIG. 3A, the LED head 29 is arranged between the toner cartridge 20 and the lower end of the sheet output tray 9, and movable in a direction across a plane connecting the sheet output tray 9 and the toner cartridge 20. As best seen in FIG. 8A, the LED head 29 is provided with the slide protrusion 29*a* as described above, and a spring biased portion 29*b* formed on the outside (in the right-and-left direction) of the slide protrusion 29*a* on each side (only left side is shown in the figure), and a buffer spring 29*d* and an abutment member 29*e* on the front surface 29*c* of the LED head 29.

Figure 8B:
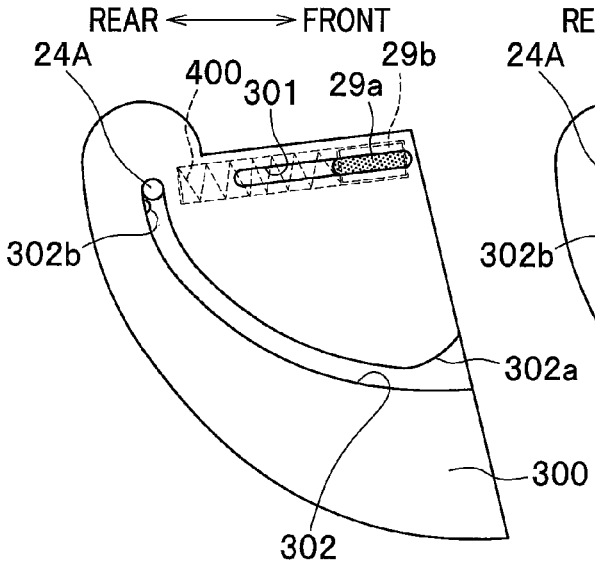
Figure 8C:
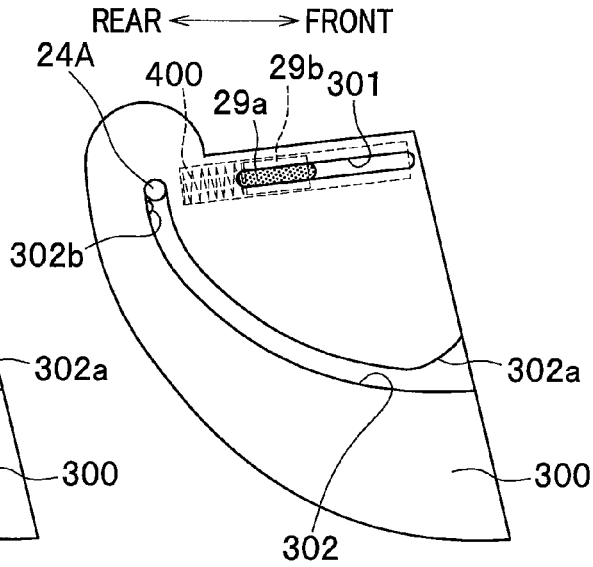

The spring biased portion 29*b* is rectangularly shaped, and as seen in FIGS. 8B and 8C, the spring biased portion 29*b* is always urged substantially in the frontward direction by a retracting spring 400 to be described later. The spring biased portion 29*b* is formed such that the vertical height thereof is greater than that of the slide protrusion 29*a*. Therefore, the spring biased portion 29*b* reliably receives the urging force of the retracting spring 400.

As best seen in FIG. 4A, the buffer spring 29*d* is positioned between the LED head 29 and the abutment member 29*e*. The buffer spring 29*d* absorbs a shock and protects the LED head 29 when the operating portion 206 is brought into contact with the abutment member 29*e*.

The buffer spring 29*d* also absorbs a play (backlash) caused between the slide protrusion 29*a* of the LED head 29 and the engagement groove 192*a* for guiding the slide protrusion 29*a*. Therefore, it is possible to perform accurate positioning of the LED head 29 with respect to the photosensitive drum 24.

Structure of Main Body Casing

Figure 9:
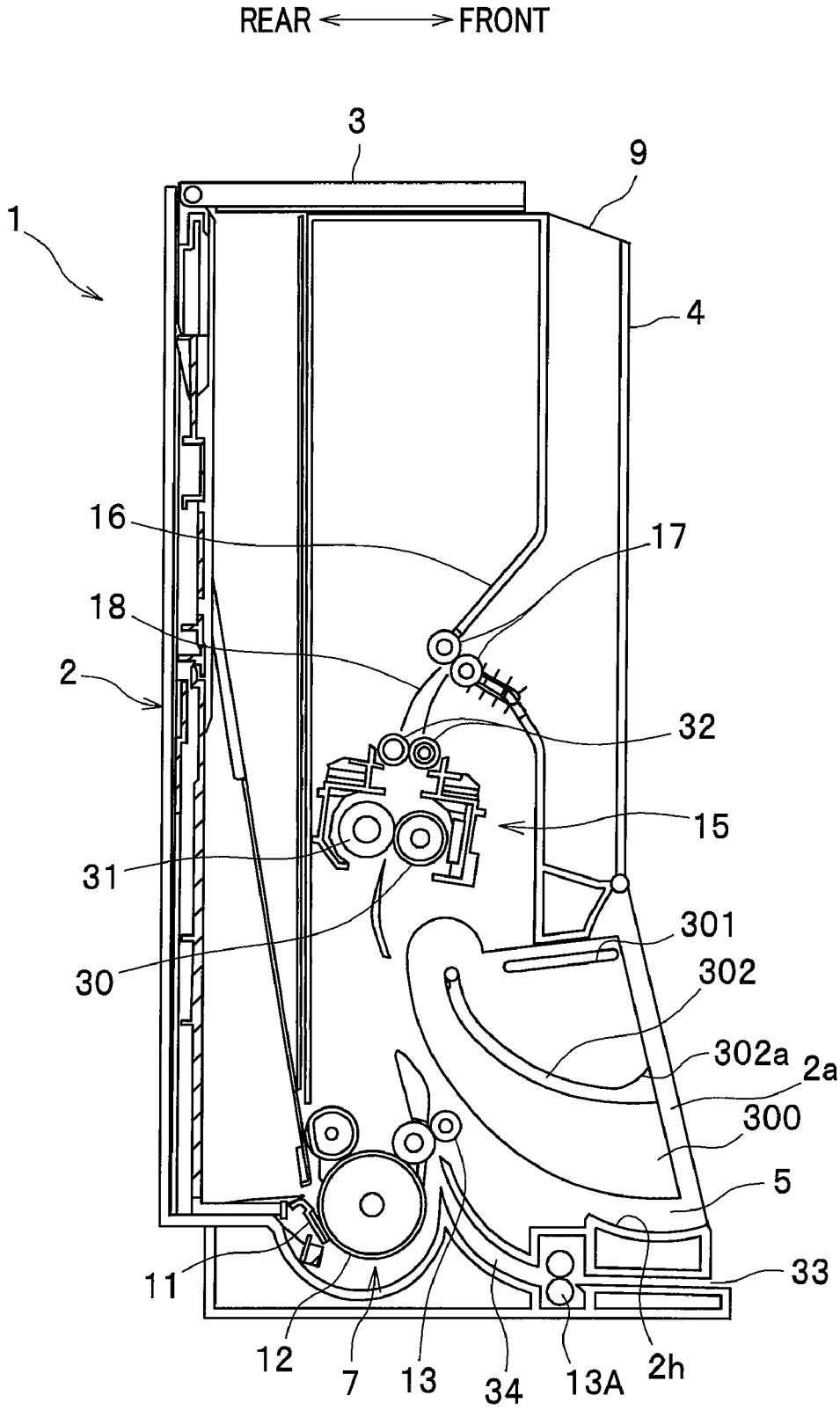
FIG. 9 is a vertical section of the printer illustrating a state where the process cartridge is removed from the main body casing.

As seen in FIG. 9, a support panel 300 is provided for each of right and left side walls 2*a* of the main body casing 2. The support panels 300, 300 define the moving passage of the LED head 29 and the moving passage of the cartridge body 19. Each support panel 300 is positioned near the attachment opening 5 of the main body casing 2, and has a linear guide groove 301 for slidably guiding the slide protrusion 29*a* of the LED head 29 and an arcuate guide groove 302 for defining the moving passage of the cartridge body 19.

As best seen in FIGS. 8B and 8C, each guide groove 301 has a width such that a predetermined sized play is formed when the slide protrusion 29*a* of the LED head 29 is positioned in the guide groove 301. The guide groove 301 guides the slide protrusion 29*a* to the engagement groove 192*a* of the cartridge body 19 (FIGS. 7A and 7B). Further, as seen in FIG. 8A, the side wall 2*a* is positioned outside of the guide groove 301. The side wall 2*a* has a support groove 2*b* as an example of a guide portion along which the spring biased portion 29*b* of the LED head 29 is slidably guided. The retracting spring 400 is mounted on the rear end surface of the support groove 2*b*. The retracting spring 400 always urges the spring biased portion 29*b* of the LED head 29 in the forward direction, so that when the LED head 29 is not pressed by the operating portion 206 of the toner cartridge 20, the retracting spring 400 causes the LED head 29 to be positioned in a retracted position (second position). According to this preferred embodiment, the support groove 2*b* is formed in the side wall 2*a* of the main body casing 2. However, the present invention is not limited to this specific embodiment. For example, the support panel 300 maybe provided with ribs between which a support groove is formed.

Herein, the retracted position indicates a position where the LED head 29 is retracted or positioned away from the photosensitive drum 24 for a predetermined distance. To be more specific, in the retracted position the LED head 29 does not interfere with the cartridge body 19 moving along the guide grooves 302, 302 as an example of an attachment guide. The retracting spring 400 is set to provide less urging force than the buffer spring 29*d* does. Therefore, when the LED head 29 is pressed by the operating portion 206, the retracting spring 400 reliably contracts to allow a smooth movement of the LED head 29.

Since the LED head 29 is slidably supported along the guide grooves 301, 301 formed in the main body casing 2 and the engagement grooves 192*a*, 192*a* formed in the cartridge body 19, the LED head 29 is movable between the light-exposure position as shown in FIG. 3A and the retracted position as shown in FIG. 3B. In the light-exposure position of FIG. 3A, the LED head 29 is positioned between the photosensitive drum 24 and the operating portion 206 of the toner cartridge 20.

The guide grooves 302, 302 extend gradually arcuately upward from the front side toward the rear side of the main body casing 2, and a rotation shaft 24A of the photosensitive drum 24 (FIGS. 7A and 7B) that protrudes outward through both side walls 192 of the cartridge body 19 is slidably engaged with the guide grooves 302, 302. A taper-shaped guide surface 302*a* is formed at the front end of each guide groove 302 to facilitate inserting the rotation shaft 24A of the photosensitive drum 24 into the corresponding guide groove 302. An elastically deformable retaining spring 302*b* is provided at the rear side of each guide groove 302. Therefore, when the user slides the rotation shaft 24A of the photosensitive drum 24 along the guide grooves 302, 302 to the rear ends against the urging force of the retaining springs 302*b*, 302*b*, the retaining springs 302*b*, 302*b* are deformed and then returned to their original position to retain both ends of the rotation shaft 24A. Therefore, the cartridge body 19 is mounted to the main body casing 2.

As seen in FIG. 9, the main body casing 2 is provided, on each side, with a restriction wall 2*h*, which is partly engageable with the lower end of the process cartridge 14 to prevent the process cartridge 14 that has been attached to the main body casing 2 from accidentally becoming detached from the main body casing 2. Therefore, the process cartridge 14 is stably attached to the main body casing 2 by the restriction walls 2*h*, 2*h* and the retaining springs 302*b*, 302*b*.

Structure of Fixing Device

As best seen in FIG. 9, the fixing device 15 includes a heating roller 30 and a pressure roller 31 which are positioned oppositely and rotate to pinch and convey a paper toward the sheet output tray 9, and a pair of conveyance rollers 32, 32. The pair of conveyance rollers 32, 32 are positioned downstream of the sheet conveyance passage from the heating roller 30 and the pressure roller 31. These conveyance rollers 32, 32 feed the paper along the sheet guide 18 to the sheet ejection rollers 17, 17 that are provided at the recess 16 of the sheet output tray 9.

Operation of Fixing Device

A paper on which a toner image has been transferred between the photosensitive drum 24 and the transfer roller 26 in the process cartridge 14 is conveyed and passes between the heating roller 30 and the pressure roller 31 provided in the fixing device 15. During the conveyance of the paper, the toner image formed on the paper is thermally fixed by the heating roller 30.

Sheet Conveyance Passage

As seen in FIGS. 3A and 3B, the sheet conveyance passage along which a paper is conveyed extends from the sheet feed tray 6 toward the sheet output tray 9. The sheet conveyance passage has a substantially U-shaped configuration and is defined by a pick-up roller 11A, the separation roller 12, a sheet guide 12A, the registration roller 13, the photosensitive drum 24 and the transfer roller 26, the heating roller 30 and the pressure roller 31, the conveyance rollers 32, 32, the sheet guide 18, and the sheet ejection rollers 17, 17. Of this conveyance passage, the passage from the lower end of the separation roller 12 to the sheet ejection rollers 17, 17 is directed to the upward direction.

The substantially U-shaped sheet conveyance passage directly connects the sheet feed tray 6, the sheet feed opening 6A, and a sheet discharge opening (space between the sheet ejection rollers 17, 17) of the sheet output tray 9. Further, in this U-shaped sheet conveyance passage, the vertical distance from the sheet feed opening 6A of the sheet feed tray 6 to the bottom portion of the conveyance passage (bottom portion of the sheet guide 12A), which is also referred to as a "downward conveyance passage", is smaller than the vertical distance from the bottom portion of the conveyance passage to the sheet discharge opening of the sheet output tray 9, which is also referred to as an "upward conveyance passage". Therefore, the registration roller 13, the process cartridge 14, and the fixing device 15 can be arranged in this order along the upward conveyance passage.

According to this embodiment, the pick-up roller 11A is a roller for feeding a paper downward from the sheet feed opening 6A. The sheet guide 12A is arranged on the opposite side of the separation roller 12. The sheet guide 12A is a U-shaped guide whose inner surface curves in conformity with the outer shape of the separation roller 12.

Structure of Manual Sheet Feed Unit

As seen in FIG. 9, a manual sheet feed opening 33 is formed below the attachment opening 5 of the main body casing 2, through which a paper is manually supplied from the front side of the printer 1. The manual sheet feed opening 33 continues to a manual sheet feed passage 34, which extends arcuately upward from a sheet supply roller 13A to the registration roller 13, thereby providing a manual sheet feed unit.

The following describes attachment and detachment of the cartridge body 19 to and from the main body casing 2, and attachment and detachment of the toner cartridge 20 to and from the cartridge body 19 that is attached to the main body casing 2.

Attachment/Detachment of Cartridge Body

Figure 10B:
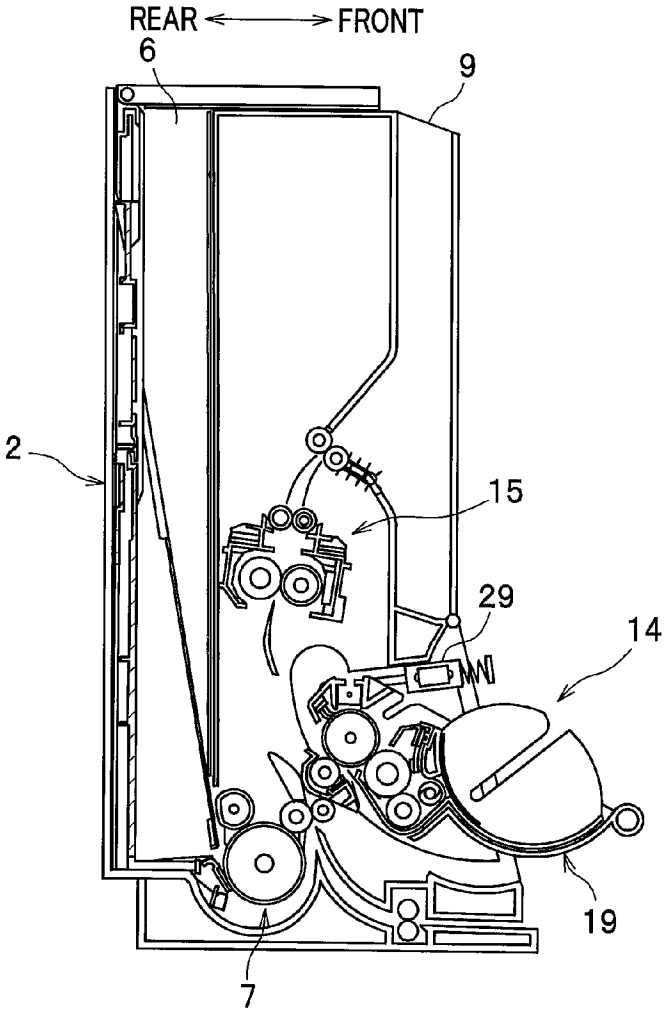
Figure 10A:
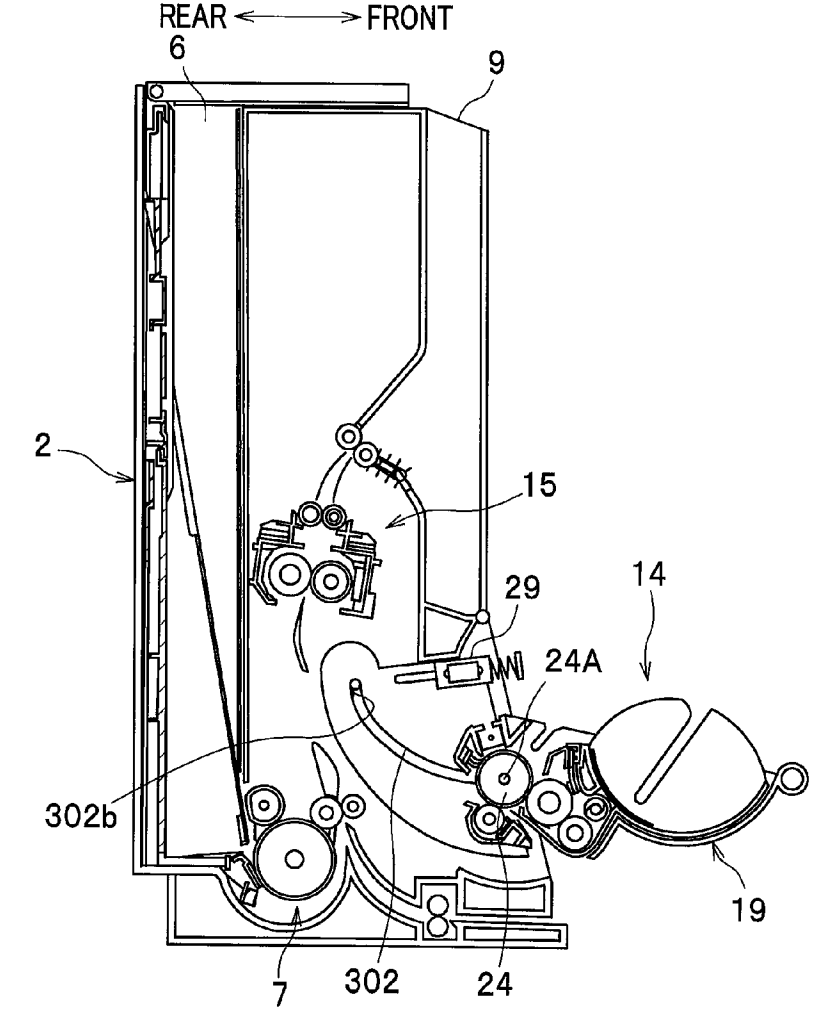
Figure 11B:
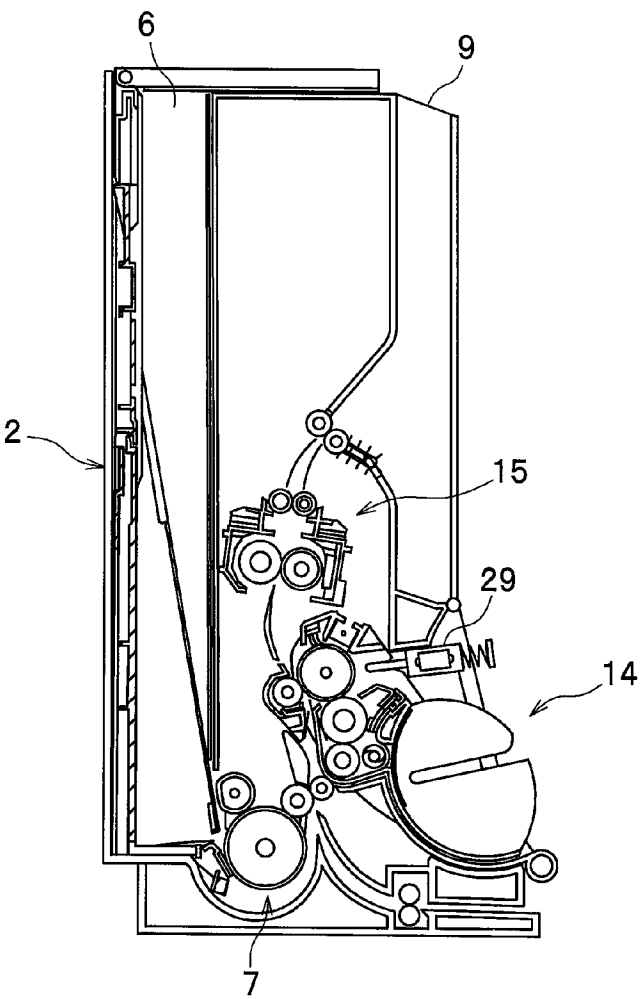
Figure 11A:
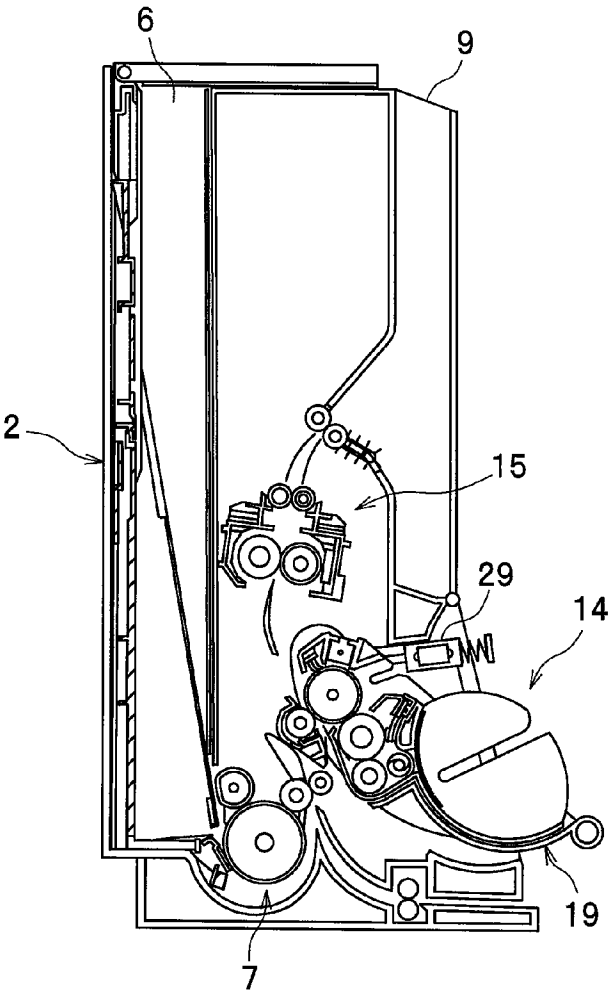

As seen in FIG. 10A, the user brings the rotation shaft 24A of the photosensitive drum 24 that protrudes from the both side surfaces of the cartridge body 19 into engagement with the guide grooves 302, 302, and moves the cartridge body 19 farther into the main body casing 2. The cartridge body 19 then slides along the guide grooves 302, 302 as shown in FIGS. 10A, 10B and 11A without any substantial resistance until the rotation shaft 24A is brought into contact with the retaining springs 302*b*, 302*b*. When the rotation shaft 24A contacts with the retaining springs 302*b*, 302*b*, the user presses the cartridge body 19 farther with a strong force. The retaining springs 302*b*, 302*b* are deformed and depressed down to allow the passage of the rotation shaft 24A and then returned to their original positions, so that the cartridge body 19 is attached to a predetermined position of the main body casing 2 as shown in FIG. 11B. Upon attachment of the cartridge body 19 to the main body casing 2, since a force applied by the user to the cartridge body 19 is directed to the upward direction due to the upper shape of the guide grooves 302, 302, the vertically elongated shaped printer 1 is subject to less pressing force in the horizontal direction so that the attachment of the cartridge body 19 is stably performed. Upon detachment of the cartridge body 19 from the main body casing 2, the cartridge body 19 is pulled out toward the front from the attachment opening 5 of the printer 1 while the main body casing 2 is pressed in the downward direction. Therefore, the cartridge body 19 is removed from the main body casing 2 in a stable manner. This can reliably prevent the printer 1 from falling down when the cartridge body 19 is attached to and detached from the main body casing 2, thereby leading to improved operationality of the printer 1.

Upon attachment or detachment of the cartridge body 19, the cartridge body 19 alone or in combination with the toner cartridge 20 may be attached to or detached from the main body casing 2. The cartridge body 19 is attached to or detached from the main body casing 2 along the guide grooves 302, 302, as shown in arrow A of FIG. 3B.

Attachment/Detachment of Toner Cartridge

The user first brings the protrusions 205, 205 and the rotation shaft 42A of the agitator 42 (see FIGS. 5A and 5B) that protrude outward from both end surfaces of the toner cartridge 20 into engagement with the guide grooves 14B, 14B formed in the cartridge body 19 (see FIG. 7B), and then moves the toner cartridge 20 farther into the recess 193 of the cartridge body 19. The toner cartridge 20 then slides along the guide grooves 14B, 14B without any substantial resistance until the protrusions 205, 205 are brought into contact with the retaining springs 14D, 14D. When the protrusions 205, 205 contact with the retaining springs 14D, 14D, the user presses the toner cartridge 20 farther with a strong force. The retaining springs 14D, 14D are deformed and depressed down to allow the passage of the protrusions 205, 205 and then returned to their original positions, so that the toner cartridge 20 is attached to a predetermined position of the cartridge body 19 as shown in FIGS. 4A and 4B. Attachment of the toner cartridge 20 in this manner causes the engagement protrusions 207, 207 (FIG. 5B) that protrude from the outer peripheral surface of the toner cartridge 20 to be fitted into the engagement openings 195*a*, 195*a* of the rotary wall 195 (FIG. 7B).

When the user operates and rotates the operating portion 206 in the rearward direction from the position of FIG. 5B to the position of FIG. 5A, the outer cylinder 20B is rotated to release the toner supply opening 201 and the toner return opening 202 formed in the inner cylinder 20A. At the same time, the rotary wall 195 slides in the downward direction to release the toner supply opening 193*a* and the toner return opening 193*b* formed in the cartridge body 19. During this time, the sponge members 203B, 204B of the outer cylinder 20B and the sponge members 201A, 202A of the inner cylinder 20A are engaged with each other so that the operating portion 206 is retained in the open position as shown in FIG. 5A with a predetermined frictional force.

When the operating portion 206 is retained in the open position, the logo 14A indicated on the toner cartridge 20 can be seen from the front side of the printer 1 as seen in FIG. 1. To be more specific, when the operating portion 206 is in the open position as shown in FIG. 3A, the logo 14A is directed to the front side and therefore it can be easily seen from the front side. However, when the operating portion 206 is rotated from the open position to the closed position, the logo 14A is directed to a diagonally lower direction as shown in FIG. 3B where the logo 14A is not easily visible from the front side. In this manner, the user can easily check, from the position of the logo 14A, whether the openings of the toner cartridge 20 such as the toner supply opening 201 are in the open position. Of course, any shape or character(s) may be used in place of the logo 14A.

When the user operates and rotates the operating portion 206 in the forward direction from the position of FIG. 3A to the position of FIG. 3B, the toner cartridge 20 can be separately detached from the cartridge body 19.

Further, as seen in FIGS. 3A and 3B, the LED head 29 is moved between the light-exposure position and the retracted position in association with the rotating operation of the operating portion 206. To be more specific, when the user operates and rotates the operating portion 206 from the closed position to the open position, the LED head 29 is pressed by the pressing wall 206*a* of the operating portion 206 and positioned in the light-exposure position. The buffer spring 29*d* mounted on the front end of the LED head 29 absorbs and eases a shock that is applied from the operating portion 206 and received by the LED head 29. When the operating portion 206 is rotated from the open position to the closed position, as seen in FIG. 3B, the LED head 29 is disengaged from the engagement grooves 192*a*, 192*a* of the cartridge body 19 and retracted to the retracted position. After the LED head 29 is disengaged from the cartridge body 19 and moved to the retracted position, the cartridge body 19 is ready for removal from the main body casing 2.

According to the printer 1 as described above, the following advantages can be obtained:

(1) Since the LED head 29 is pressed by the pressing wall 206*a* of the toner cartridge 20 that is accurately positioned in the cartridge body 19 in order to supply developer in a reliable manner, it is possible to accurately press the LED head 29 and to perform accurate positioning between the LED head 29 and the photosensitive drum 24. Further, when compared with the conventional structure in which the LED head is supported on the top cover, the accurate positioning of the LED head is readily performed according to the printer 1 as described above. Further, the moving passage (trajectory) of the LED head 29 can be shortened to such an extent that the pressing wall 206*a* of the toner cartridge 20 causes the LED head 29 to move toward the photosensitive drum 24, it is possible to effectively use the internal space of the printer 1.

(2) Since the pressing wall 206*a* of the toner cartridge 20 is movable between the pressing position and the disengaged position, the user can attach the toner cartridge 20 to the main body casing 2 such that the pressing wall 206*a* (pressing portion) of the toner cartridge 20 is positioned in the disengaged position, and then the user can move the pressing wall 206*a* in the pressing position.

This attachment of the toner cartridge 20 is advantageous because the pressing wall 206*a* is prevented from striking the LED head 29 with a strong impact upon attachment of the toner cartridge 20 to the main body casing 2. Therefore, it is possible to prevent deformation of the LED head 29 and supporting members for the LED head 29, and hence to prevent a decrease in the positioning accuracy of the LED head 29 with respect to the photosensitive drum 24.

(3) The guide grooves (attachment guide) 302, 302 are configured to guide the cartridge body 19 to which the toner cartridge 20 has been attached in a direction across a plane extending along the direction in which the LED head 29 is movable. This can reliably prevent the pressing wall 206*a* from striking the LED head 29 with a strong impact upon attachment of the toner cartridge 20 to the main body casing 2. Therefore, it is possible to more reliably prevent deformation of the LED head 29 and supporting members for the LED head 29, and hence to more reliably prevent a decrease in the positioning accuracy of the LED head 29 with respect to the photosensitive drum 24.

(4) Providing the sponges (restriction member) 203B, 204B advantageously restricts the pressing wall 206*a* from moving into the pressing position when the toner cartridge 20 is attached to the main body casing 2. This can reliably prevent the pressing wall 206*a* from striking the LED head 29 with a strong impact upon attachment of the toner cartridge 20 to the main body casing 2. Therefore, it is possible to more reliably prevent deformation of the LED head 29 and supporting members for the LED head 29, and hence to more reliably prevent a decrease in the positioning accuracy of the LED head 29 with respect to the photosensitive drum 24.

(5) The LED head 29 is positioned in the retracted position when the openings of the toner cartridge 20, such as the toner supply opening 201, are closed, so that the user can recognize if the printer 1 is not ready to print on a paper. Further, since the LED head 29 is pressed by the pressing wall 206*a* of the operating portion 206 that is rotatably operated, the pressing wall 206*a* does not strike the LED head 29 with a strong impact. Therefore, it is possible to prevent distortion of the LED head 29 and the supporting structure of the LED head 29 such as the slide protrusions 29*a*, 29*a*, the guide grooves 301, 301, and the engagement grooves 192*a*, 192*a*, and hence to reliably prevent a decrease in the positioning accuracy of the LED head 29 with respect to the photosensitive drum 24.

(6) When the toner cartridge 20 is not attached to the cartridge body 19, the outer cylinder 20B closes the openings (toner supply opening 201, etc.) of the inner cylinder 20A in order to prevent a leakage of developer from the toner cartridge 20. Further, when the outer cylinder 20B closes the openings with the toner cartridge 20 being attached to the cartridge body 19, the pressing wall 206*a* is released from the LED head 29. This can prevent the pressing wall 206*a* from striking the LED head 29 with a strong impact upon attachment of the toner cartridge 20 to the cartridge body 19. Therefore, it is possible to prevent distortion of the LED head 29 and the supporting structure of the LED head 29 such as the slide protrusions 29*a*, 29*a*, the guide grooves 301, 301, and the engagement grooves 192*a*, 192*a*, and hence to more reliably prevent a decrease in the positioning accuracy of the LED head 29 relative to the photosensitive drum 24.

(7) When the outer cylinder 20B closes the openings, the pressing wall 206*a* is positioned away from the LED head 29. This can prevent a collision of the pressing wall 206*a* with the LED head 29 upon attachment of the toner cartridge 20 to the cartridge body 19. Therefore, it is possible to prevent distortion of the LED head 29 and the supporting structure of the LED head 29 such as the slide protrusions 29*a*, 29*a*, the guide grooves 301, 301, and the engagement grooves 192*a*, 192*a*, and hence to more reliably prevent a decrease in the positioning accuracy of the LED head 29 with respect to the photosensitive drum 24.

(8) Since the pressing wall 206*a* is provided as a part of the operating portion 206, the structure of the toner cartridge 20 can be simplified. As a result, the internal space of the printer 1 can be saved.

(9) Since the LED head 29 is slidably supported in the engagement grooves 192*a*, 192*a*, the LED head 29 can be supported by a simple structure when compared with the conventional structure in which the LED head is swung around a predetermined rotational axis. Further, since the engagement grooves 192*a*, 192*a* are formed linearly, the moving passage (trajectory) of the LED head 29 can be best shortened, which realizes more effective use of the internal space.

(10) Since the guide grooves 301, 301 are provided for guiding the LED head 29 to the engagement grooves 192*a*, 192*a* of the cartridge body 19, the LED head 29 is reliably movable to the engagement grooves 192*a*, 192*a* formed in the cartridge body 19. As a result, the LED head 29 is more accurately positioned relative to the photosensitive drum 24.

(11) After the toner cartridge 20 is removed from the cartridge body 19, the LED head 29 is positioned in the retracted position. Therefore, the LED head 29 does not interfere with the cartridge body 19, and the cartridge body 19 is easily removed from the main body casing 2.

(12) The LED head 29 is arranged in a small space between the sheet output tray 9 and the toner cartridge 20 in such a manner as to be slidable in a direction across a plane connecting the sheet output tray 9 and the toner cartridge 20. Therefore, it is possible to effectively use the internal space of the printer 1 and to decrease the size of the printer 1 in the direction extending along the sheet output tray 9 and the toner cartridge 20 (i.e., the vertical direction in the preferred embodiment).

(13) According to the present invention, since the LED head 29 is positioned between the photosensitive drum 24 and the toner cartridge 20, the LED head 29 is slidable in the direction across the plane connecting the sheet output tray 9 and the toner cartridge 20.

(14) The toner supply opening (supply opening) 193*a* and the toner return opening (return opening) 193*b* are formed in the recess 193 of the cartridge body 19 in such positions as to be offset from the arcuate grooves 193*c*, 193*c* as viewed along a surface of the cartridge body 19 in which the arcuate grooves 193*c*, 193*c* are formed and in a direction orthogonal to the arcuate grooves 193*c*, 193*c*, that is, as viewed in the direction of arrow B of FIG. 7A.

Normally in the process cartridge 14, the toner supply opening 193*a* and the toner return opening 193*b* are formed in a region where the thickness of the cartridge body 19 is thin. If the arcuate groove 193*c* is formed in this thin region, the arcuate groove 193*c* may protrude from a back side of the recess 193, and a protruding portion may be formed inside the development chamber DR. Such a protruding portion disadvantageously may hinder a flow of toner within the process cartridge 14, which may lead to deteriorated image quality.

In the above preferred embodiment, since the arcuate grooves 193*c*, 193*c* are disposed out of the thinned region in which the tonner supply opening 193*a* and the toner return opening 193*b* are formed, toner can flow smoothly in the cartridge body 14 and improved image quality can be provided.

Although the present invention has been described in detail with reference to the above preferred embodiment, the present invention is not limited to this specific embodiment and various changes and modifications may be made without departing from the scope of the appended claims.

In the above preferred embodiment, the LED head 29 has a plurality of LEDs as a plurality of light-emitting portions. However, a plurality of light-emitting portions may be formed from only one light-emitting element such as an LED. For example, one backlight such as a fluorescent lamp may be provided, and optical shutters consisting of a row of liquid crystal elements or PLZT elements may be arranged outside the backlight. Namely, the combination of one light-emitting element and a row of optical shutters can provide a row of plural light-emitting portions. Instead of providing the optical shutters in a row, shutters may be arranged in plural rows. Further, the light-emitting element is not limited to an LED, and an electroluminescence (EL) element or a luminescent material may be used as the light emitting element.

The LED head 29 slides along the linear trajectory according to the above preferred embodiment. However, the present invention is not limited to this specific embodiment, and the LED head 29 may be slidable along a curved trajectory.

The retracting spring 400 is provided to urge the LED head 29 in the retracted position according to the above preferred embodiment. However, the present invention is not limited to this specific embodiment. For example, the LED head 29 may be manually or electrically moved in the retracted position.

The LED head 29 is pressed by utilizing an operating force upon rotating the operating portion 206 according to the above preferred embodiment. However, the LED head 29 may be pressed by utilizing an operating force upon attachment of the toner cartridge 20 to the cartridge body 19.

The pressing wall 206*a* is provided as a part of the operating portion 206 according to the above preferred embodiment. However, the pressing wall may be separately provided on the outer peripheral surface of the outer cylinder 20B and the operating portion may be provided on an end surface of the outer cylinder.

In the above preferred embodiment, the present invention has been applied to the printer 1 as an example of an image forming apparatus. However, the present invention maybe applicable to other image forming apparatuses such as a multifunction device.

Further, the toner cartridge 20 is attached to and detached from the cartridge body 19 that has been attached to the main body casing 2 according to the above preferred embodiment. However, the process cartridge 14 per se may be attached to and detached from the main body casing 2 with the toner cartridge 20 being attached to the cartridge body 19. This is advantageous because a paper is easily removed if a paper jamming happens around the photosensitive drum 24.

The toner cartridge 20 is directly attached to the cartridge body 19 according to the above preferred embodiment. However, the toner cartridge 20 may be indirectly attached to the cartridge body 19 through another member such as a tube through which the toner passes, and a developer cartridge equipped with a developing roller.

In the above preferred embodiment, the printer 1 is configured as an upright-type printer. However, the present invention may be applicable to a horizontal-type printer, in which the printer 1 described in the above preferred embodiment is tilted backward by 90 degrees.

What is claimed is:

1. An image forming apparatus comprising:

a process unit including a photosensitive element;

an exposure member configured to expose the photosensitive element to light to form an electrostatic latent image on the photosensitive element;

a main body casing configured to accommodate the process unit and the exposure member; and a developer cartridge configured to supply developer to the process unit, the developer cartridge being configured to be attached to and removed from the process unit, wherein the exposure member is positioned between the photosensitive element and the developer cartridge so as to be attached and movable between a first position in which the photosensitive element is exposed to light by the exposure member and a second position in which the exposure member is away from the photosensitive element; and wherein the developer cartridge has a pressing portion, and the pressing portion is configured to press the exposure member toward the first position with the developer cartridge being attached to the main body casing.

2. An image forming apparatus according to claim 1, wherein when the developer cartridge is attached to the main body casing, the pressing portion is movable between a pressing position in which the pressing portion urges the exposure member toward the first position and a disengaged position in which the pressing portion is disengaged from the exposure member to release the exposure member from the first position.

3. An image forming apparatus according to claim 2, further comprising an attachment guide configured to guide attachment and detachment of the process unit with respect to the main body casing, wherein the attachment guide is configured to guide the process unit in a direction across a plane extending along a direction in which the exposure member is movable.

4. An image forming apparatus according to claim 2, further comprising a restriction member configured to restrict the pressing portion from moving to the pressing position with the developer cartridge being attached to the main body casing.

5. An image forming apparatus according to claim 2, wherein the developer cartridge further comprises an opening through which the developer is to be supplied to the process unit, a first shutter movable between an open position and a closed position to open and close the opening, and an operating portion operable to move the first shutter, and wherein the pressing portion is connected to the first shutter so that when the first shutter is in the open position, the pressing portion is positioned in the pressing position, and when the first shutter is in the closed position, the pressing portion is positioned in the disengaged position.

6. An image forming apparatus according to claim 5, wherein the pressing portion is disposed on the operating portion.

7. An image forming apparatus according to claim 5, wherein the process unit includes a supply opening through which developer is to be supplied from the developer cartridge, and a second shutter movable between an open position and a closed position to open and close the supply opening, the second shutter having an engagement hole, wherein the first shutter of the developer cartridge has an engagement protrusion. engageable with the engagement hole of the second shutter, wherein the process unit further includes a groove for allowing a distal end of the engagement protrusion protruding from the engagement hole to slide therealong, and wherein the groove and the supply opening are offset from each other as viewed along a surface of the process unit in which the groove is formed and in a direction orthogonal to the groove.

8. An image forming apparatus according to claim 7, wherein the process unit further includes a return opening through which developer is to be returned to the developer cartridge, and wherein the groove and the return opening are offset from each other as viewed along the surface of the process unit in which the groove is formed and in the direction orthogonal to the groove.

9. An image forming apparatus according to claim 2, wherein the developer cartridge is positioned such that the pressing portion is in the disengaged position.

10. An image forming apparatus according to claim 1, wherein the process unit comprises an engagement portion along which the exposure member is slidable to the first position.

11. An image forming apparatus according to claim 10, wherein the main body casing comprises a guide portion which is configured to guide the exposure member to the engagement portion.

12. An image forming apparatus according to claim 1, further comprising a sheet output tray for receiving and storing a recording sheet on which a developer image has been transferred from the photosensitive element, wherein one end of the sheet output tray is positioned opposite to the developer cartridge, and wherein the exposure member is arranged between the one end of the sheet output tray and the developer cartridge and movable in a direction across a plane connecting the one end of the sheet output tray and the developer cartridge.

13. An image forming apparatus according to claim 1, wherein at least a part of the developer cartridge protrudes outward from the main body casing.

14. An image forming apparatus according to claim 13, wherein the developer cartridge includes an agitator which is rotatably driven in the developer cartridge to agitate developer, and wherein a rotation shaft of the agitator is positioned outside the main body casing.

* * * * *